US011834948B2

(12) United States Patent
Chang et al.

(10) Patent No.: US 11,834,948 B2
(45) Date of Patent: Dec. 5, 2023

(54) DEVICE TO EVALUATE HYDRAULIC FRACTURING DIVERSION MATERIAL BEHAVIOR AND PERFORMANCE

(71) Applicant: ARAMCO SERVICES COMPANY, Houston, TX (US)

(72) Inventors: Fakuen Frank Chang, Houston, TX (US); Wenwen Li, Pearland, TX (US); Nam Mai, Richmond, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 68 days.

(21) Appl. No.: 17/644,883

(22) Filed: Dec. 17, 2021

(65) Prior Publication Data

US 2022/0220847 A1 Jul. 14, 2022

Related U.S. Application Data

(60) Provisional application No. 63/135,137, filed on Jan. 8, 2021.

(51) Int. Cl.

| | |
|---|---|
| ***G01N 11/04*** | (2006.01) |
| ***G01N 15/08*** | (2006.01) |
| ***E21B 49/00*** | (2006.01) |
| ***E21B 49/08*** | (2006.01) |
| ***E21B 43/12*** | (2006.01) |
| ***E21B 34/08*** | (2006.01) |
| ***E21B 43/26*** | (2006.01) |

(52) U.S. Cl.

CPC ..... *E21B 49/008* (2013.01); *E21B 34/08* (2013.01); *E21B 43/12* (2013.01); *E21B 43/261* (2013.01); *E21B 49/08* (2013.01)

(58) Field of Classification Search

None

See application file for complete search history.

(56) References Cited

U.S. PATENT DOCUMENTS

| | | | | |
|---|---|---|---|---|
| 8,905,133 | B2 * | 12/2014 | Potapenko | E21B 43/261 166/305.1 |
| 9,377,392 | B2 * | 6/2016 | Rickards | G01N 11/02 |
| 9,714,565 | B2 * | 7/2017 | Blue | E21B 47/06 |
| 9,739,694 | B2 * | 8/2017 | Amanullah | C09K 8/03 |

(Continued)

FOREIGN PATENT DOCUMENTS

| | | |
|---|---|---|
| CN | 104535715 A | 4/2015 |
| CN | 105545249 A | 5/2016 |
| CN | 110118692 B | 4/2020 |

OTHER PUBLICATIONS

Shahri, Mojtaba P., et al., "An Engineered Approach to Design Biodegradables Solid Particulate Diverters: Jamming and Plugging", SPE-187433-MS, Society of Petroleum Engineers, Oct. 2017, pp. 1-32 (32 pages).

(Continued)

*Primary Examiner* — Kenneth L Thompson

(74) *Attorney, Agent, or Firm* — Osha Bergman Watanabe & Burton LLP

(57) ABSTRACT

A system and method of testing diverting agents may include injecting a diverting agent into a testing device. The system may be configured to inject a diverting agent into a testing device configured to receive a fluid through a flow channel and, change the flow channel in a transverse direction relative to the direction of the fluid flow.

21 Claims, 7 Drawing Sheets

(56) References Cited

U.S. PATENT DOCUMENTS

| | | | | |
|---|---|---|---|---|
| 9,938,811 | B2 * | 4/2018 | Bestaoui-Spurr | C09K 8/665 |
| 10,400,577 | B2 * | 9/2019 | McMurray | G01N 15/0826 |
| 11,365,626 | B2 * | 6/2022 | Anschutz | E21B 43/267 |
| 2009/0306898 | A1 * | 12/2009 | Anschutz | G01N 3/36 73/866 |
| 2018/0037803 | A1 * | 2/2018 | Dahi Taleghani | E21B 43/267 |
| 2022/0074438 | A1 * | 3/2022 | Beasley | G01F 25/10 |

OTHER PUBLICATIONS

International Search Report and Written Opinion issued in corresponding PCT International Application No. PCT/US2022/011594 dated Apr. 7, 2022 (54 pages).

* cited by examiner

DEVICE TO EVALUATE HYDRAULIC FRACTURING DIVERSION MATERIAL BEHAVIOR AND PERFORMANCE

BACKGROUND

In wellbore drilling operations, subterranean formations are fractured to access hydrocarbons in the formation. The fracturing fluid used in these operations may naturally enter the subterranean zones with the lowest rock stress or highest permeability. In certain long or heterogeneous subterranean formations, diverting stimulation techniques may be implemented, wherein a diversion process directs the fracturing fluid along multiple induced fractures in a manner that optimizes production of hydrocarbons. Diverting the fluid into target zones through diverting techniques improves both reservoir contact and well productivity.

Diverting stimulation techniques include the use of diverting agents. Diverting agents, also referred to as diverters, aid in various fracturing operations by increasing flow resistance, or blocking, in certain existing fractures to support the continued propagation of the wellbore. For example, continuous fracturing treatments employ diverting agents to allow for the fracturing fluid to by-pass previously fractured areas of low resistance so that the fracturing fluid may reach untreated formation segments. The blockage may continue temporarily, or until dislodged from the fracture, either intentionally or by failure of the diverting agent to stay in place in the fracture.

Diverting agents are designed to block certain flow channels, such as natural fractures, high permeability layers, and previously created fractures or dissolution channels, thereby allowing the operations such as continuous fracturing treatments or acid fracturing treatments to open new formation segments. Implementing diversion techniques with diverting agents may also increase stimulated reservoir volume (SRV) in coal-bed methane (CBM) and shale reservoir. High viscosity, physical blocking, or particle bridging are typical mechanisms of the diverting agent process.

In certain drilling operations, once a formation is identified as requiring a diverting agent to help production, the diverting agent is injected into the target area of the fracture until flow into the identified fracture is stopped by the diverting agent. Once flow is stopped, the conditions in a fracture do not remain static. A fracture may undergo dynamic changes in the presence of the diverting agent. For example, the fracture geometry may be continuously changing, either by acid dissolution during acid fracturing or the elevated wellbore pressure required to open higher stressed formations. The change in width may loosen the blockage created by the diverting agent, thus allowing undesirable flow through the existing fracture.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to method of testing diverting agents, including injecting a diverting agent into a testing device configured to receive a fluid through a flow channel and changing the flow channel in a transverse direction relative to the direction of the fluid flow.

In another aspect, embodiments disclosed herein relate to a method of testing diverting agents, including injecting a diverting agent into a first opening of a chamber, the chamber including at least one plate defining a width of a flow channel, changing the position of the at least one plate, thereby changing the flow channel in a transverse direction relative to fluid flow therein, and measuring the pressure profile of the diverting agent along the plate.

In another aspect, embodiments disclosed herein relate to a system to test diverting agents, including a chamber configured for a fluid flow, wherein the chamber includes at least one plate extending therethrough from a first opening to a second opening, thereby defining a length of a fluid channel, the plate fitted within the chamber and configured to move transverse to the fluid flow, thereby changing a width of the fluid channel.

Other aspects and advantages of the claimed subject matter will be apparent from the following description and the appended claims.

BRIEF DESCRIPTION OF DRAWINGS

FIG. 5-6 show diverting agent flow through embodiments of the dynamic testing apparatus.

DETAILED DESCRIPTION

Figure 1:
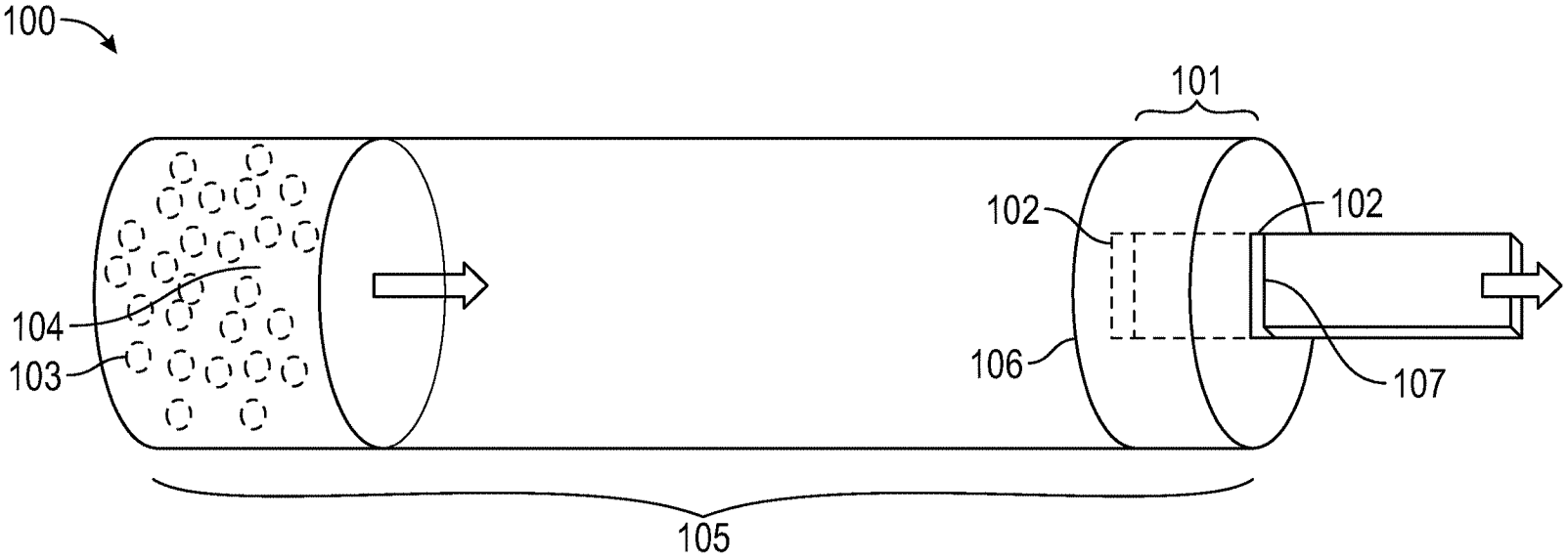
FIG. 1 is a schematic of a fixed slot testing device.

Embodiments of the present disclosure are directed to testing devices that can test diverting agents used in fracturing operations. In particular, the testing devices of the present disclosure may reflect the dynamic conditions present in the subterranean formation, specifically change in fracture or flow channel sizes.

Generally, laboratory testing devices for diverting agents employ fixed simulated fracture dimensions, as well as other static conditions. However, the testing and evaluation of diverting agents is desired to be representative of the dynamic conditions present in the subterranean formations to more accurately capture the effectiveness of the diverting agent. Testing apparatuses and methods in accordance with one or more embodiments described herein may more accurately simulate real world applications ensure the best choice of diverting agent for the fracturing operation, as well as identify opportunities to improve the properties of diverting agents by changing a width of the flow channel in the testing device (transverse to direction of fluid fluid). Thus, one or more embodiments of the present disclosure may be able to simulate realistic conditions of the multiple fracture initiation and propagation process when testing the efficacy and performance of diverting agents.

Multiple fracturing and multi-stage fracturing operations often require injecting/pumping diverting agents to stop the growth of existing fractures. Diverting agents are designed to prevent a treating fluid in a fracturing operation from entering an existing dominant flow channel, such as a water zone or a high permeability zone. The treating fluid is directed in a manner that creates new fractures. Diverting agents operate by controlling the flow of the treating fluid by directing it from a high permeability zone to a lower permeability zone, thereby aiding in the propagation of new fracture segments. Diverting agents may also aid in increasing the stimulated reservoir volume and network acid fracturing in a target zone.

Once the diverting agent is injected into the fracture, the conditions inside the wellbore may cause the geometry of the fracture to dynamically change and/or the fracture geometry changes along its length. This fluctuation in fracture dimensions may be caused by the changes in pressure and temperature of the subterranean environment, as well as permeability of the formation. For example, the width of a fracture may increase, at least partially due to the increased pressure required to create new fractures. This may occur in fracturing operations such as hydraulic fracturing. The increase in fracture width may occur in other fracturing operations, such as acid fracturing, particularly due to the continued dissolution of rock by the acid. Thus, by changing a width of the flow channel in the testing device, the impact of such change on the diverting agent may be considered.

For example, such diverting agents may be categorized as chemical particle, fiber, gel, surfactant, (such as foam diversion acids, emulsified diversion acids, and self-diverting acids), composite and phase-transition diverting agents (such as thermo-responsive diverting agent and liquid nitrogen).

The efficacy of diverting agents is evaluated with testing equipment that simulate downhole fracture, multiple fracture and propagation operations. The closer the equipment simulates realistic conditions in a downhole environment, the more likely the testing will provide a realistic prediction of how well the diverting agent will perform downhole. For example, accurate representation of fracture geometry and dimensions should be property considered and replicated in the testing method as well as the temperature and pressure of the subsurface conditions.

Conventional fracture diversion testing methods and devices implement fixed downhole simulations. As seen in FIG. 1, fixed slot testing device 100 uses a metal disk 101 with a slot 102 of fixed dimensions along the axial direction along the metal disk 101. Slot 102 is comprised of a slot inlet 106 and a slot outlet 107. The fluid 104 and diverting agent 103 flows through the testing chamber 105 and through the slot inlet 106 and slot outlet 107 until the diverting agent 103 builds enough resistance in the slot 102 to stop the flow through slot outlet 107. As the presence of the diverting agent increases in slot 102, pressure differential between slot inlet 106 and slot outlet 107 increases. Under these testing conditions, a diverting agent is considered effective with higher pressure differentials between the slot inlet 106 and slot outlet 107.

Conventional testing equipment, like the fixed slot testing device 100, fails to replicate the real world dynamic downhole conditions that impact the efficacy and performance of diverting agents. The geometry of conventional testing devices is fixed throughout the entire process. For example, the slot 102 dimensions and the simulated fracture of the testing chamber 105 width do not change throughout the testing process, nor does the dimensions of the slot inlet 106 and slot outlet 107.

In real world downhole environments, the fracture dimensions and conditions are a dynamic system. The dimensions in particular change with time as the pumping continues in the fracture. For example, the fracture width may increase once the diverting agent is injected into the fracture. This may be a result of the increased pressure, the changing temperature, and/or the strength of the formation. The increased pressure may be due to the elevated wellbore pressure required to open higher stressed formations. Higher pumping pressure may be necessary to initiate new fractures in higher stressed regions adjacent to existing fractures. In cases of acid fracturing, the previously created fracture walls may continue to change due to the acid dissolution. In the case of proppant fracturing, the previously created fractures are dynamically changed (widened and narrowed) as the pumping pressure alters the downhole conditions. The change in fracture width may loosen the blockage created by the diverting agent. Thus, conventional laboratory methods and equipment fail to capture the loosening of the diverting agent by the dynamic conditions inside a fracture, particularly the loosening that occurs during hydraulic fracturing operations. Consequently, conventional testing methods and equipment may inaccurately inflate the performance of diverting agents.

In one aspect, embodiments disclosed herein relate to reproducible test and laboratory-scale equipment that can effectively and closely simulate the dynamic conditions inside a fracture to measure the efficacy of diverting agents. In some embodiments disclosed herein, the equipment allows for better, more accurate evaluation of diverter performance, thus providing improved diverting agent performance in real world downhole fracturing operations. Improved data on diverting agents also provide opportunity for better choices on the type of diverting agents or diversion techniques. The more appropriate the choice of diverting agent given real world downhole conditions, the more potential product may be reached by propagation of new fractures.

Figure 2:
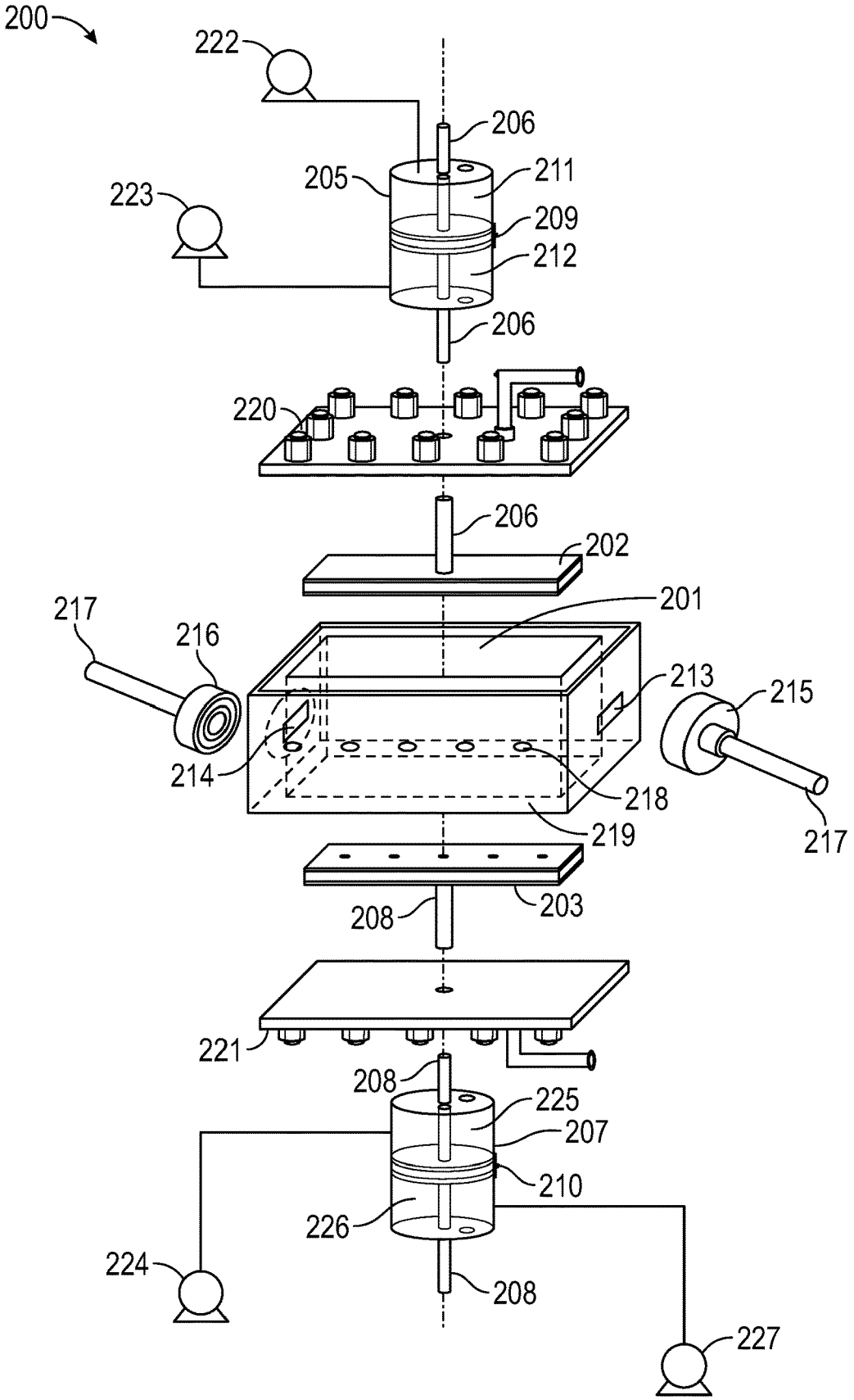
FIG. 2 is a schematic of a dynamic testing apparatus used in embodiments of the present disclosure.

FIG. 2 depicts an embodiment of a dynamic testing apparatus 200 that includes a testing chamber 201, a first plate 202, a second plate 203, that together simulate a fracture width defined by the internal dimensions of the testing chamber 201, first plate 202, and second plate 203. FIG. 2 shows the first plate 202 and second plate 203 disassembled from the dynamic testing apparatus 200 for illustration purposes, however in some embodiments of the present disclosure, the first plate 202 and second plate 203 are parallel to each other and fitted within the testing chamber 201. The first plate 202 and second plate 203 have the same shape as the internal walls of the testing chamber 201, and form a sealed enclosure with the sides of the chamber. A first wall 220 and second wall 221, as depicted in dynamic testing apparatus 200, are structural elements and shown for illustration purposes.

Figure 3:
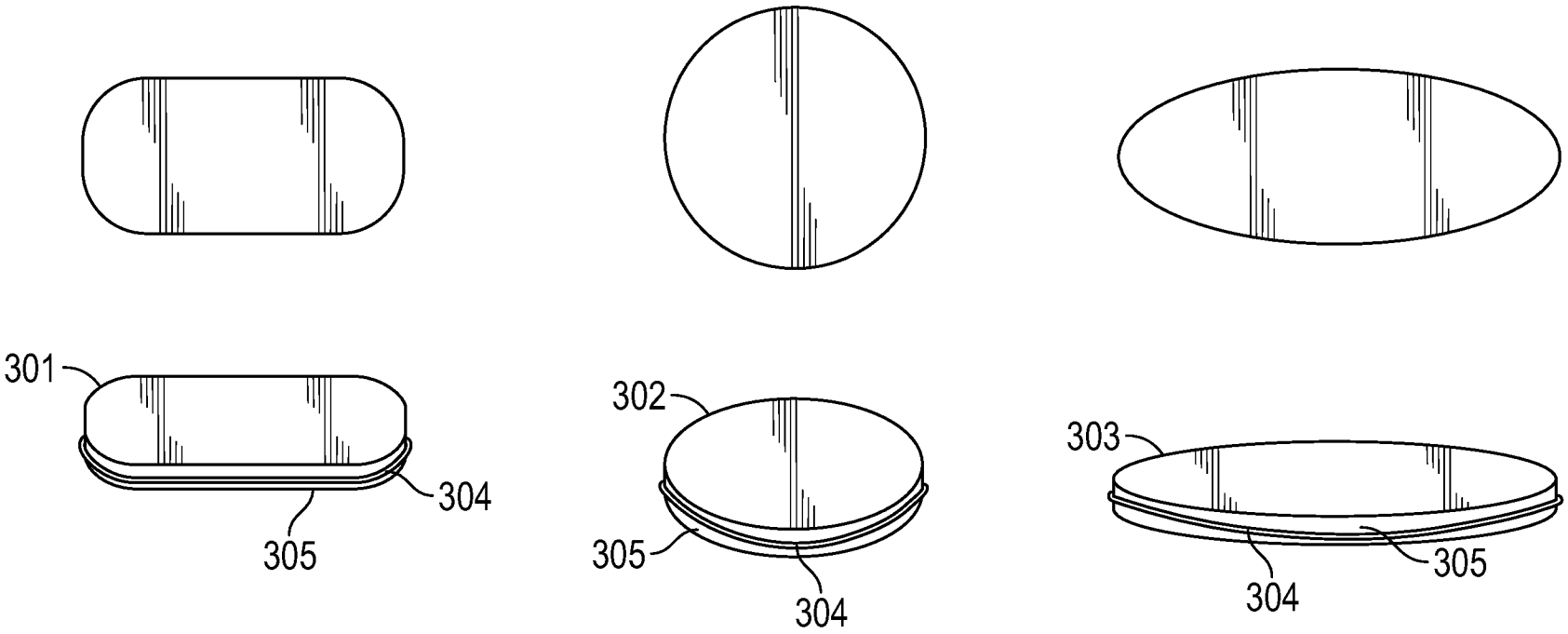
FIG. 3 shows shapes of plates fitted with O-rings used in embodiments of the present disclosure.

The sealing of a testing chamber with the perimeter of the plate may be aided by the utilization of sealing techniques. FIG. 3 depicts examples of possible shapes of plates fitted with O-rings. O-ring seal grooves 305 may be cut around the plates to hold an O-ring 304 or gasket around the perimeter of the plates, that helps to maintain the seal between the plates, such as the first plate 202, and the walls of the testing chamber 201. In addition to the rectangle shape and angular edges of the first plate 202 and second plate 203, as shown in FIG. 2, the plates may be a variety of shapes depending on the internal geometry of the testing chamber 201. Examples of possible plate shapes are rounded rectangle 301, spherical 302, and elliptical 303, and the plates may have straight edges or curved edges. In particular embodiments, the plates are curved shapes since curved shaped plates allow for improved placement of the O-ring 304 around the plate and a better connection with the internal geometry of the chamber. In some embodiments of the present disclosure, the plate shape is rounded rectangular or a super ellipse.

Some embodiments of the testing chamber may be designed appropriately for lab-bench scale testing. In one or more embodiments, the testing chamber may have any regular geometric shape, such as cylindrical, cubic, triangular prismatic, cuboidal, rectangular prismatic, hexagonal prismatic, or prismatic. In some preferred embodiments, the testing chamber is made of stainless steel, hastelloy, nickel alloy, aluminum, carbon steel, or a mixture of metals and alloys. As seen in FIG. 2, the testing chamber 201 is depicted as a rectangular, metal box. One or more embodiments of rectangular testing chambers may have an internal width on the order of 25 millimeters (mm) to 305 mm, a length on the order of 12 mm to 915 mm, and a height on the order of 177 mm to 610 mm. Additionally, the testing chamber may also be scaled up to simulate actual fracture sizes.

As shown in FIG. 2, some embodiments of the present disclosure will have a first accumulator 205 connected to the first plate 202 via a first linking rod 206 and a second accumulator 207 connected to the second plate 203 via a second linking rod 208. The first accumulator 205 and second accumulator 207 provide the mechanism for changing the width of the simulated fracture in the testing chamber 201. The term "simulated fracture", as used in one or more embodiments of the disclosure, is understood to be the space between the first plate 202 and the surface opposite to the first plate 202 (the second plate 203 as depicted in this embodiment). The first linking rod 206 is configured to move the first plate 202 in a piston-like motion in the testing chamber 201, and the second linking rod 208 is configured to move the second plate 203 in a piston-like motion in the testing chamber 201. The first linking rod 206 is attached to a first floating piston 209 in the first accumulator 205 and the second linking rod 208 is attached to a second floating piston 210 in the second accumulator 207. Although shown as multiple rods in FIG. 2, the first linking rod 206 may be one single rod that extends out both sides of the first floating piston 209 and connects directly to the first plate 202. This is also likewise for the connections of the second linking rod 208.

In some embodiments of the present disclosure, the first accumulator 205 and second accumulator 207 may be hydraulic accumulators configured to move the respective floating piston along the length of the respective accumulator. The first floating piston 209 and the second floating piston 210 move according to the fluid pressure on each side of the respective floating piston. For example, the fluid pressure on each side of the first floating piston 209 is controlled by a first accumulator pump 222 and a second accumulator pump 223. The first accumulator pump 222 and second accumulator pump 223 are connected to the first accumulator chamber 211 and second accumulator chamber 212, respectively. The first accumulator pump 222 and second accumulator pump 223 inject fluid into the respective accumulator chambers to create a differential pressure between the first accumulator chamber 211 and second accumulator chamber 212. The pressure differential forces the first floating piston 209 in the first accumulator 205 to move along the length of the first accumulator 205. The movement of the first floating piston 209 moves the first plate 202 in the testing chamber 201 via the first linking rod 206. In some embodiments, the simulated fracture in the chamber is measured and controlled by measuring the position of the first linking rod 206 extending out of the first accumulator 205, opposite of the first linking rod 206 side connected to the first plate 202, to determine the position of the first plate 202 in the testing chamber 201. The position of the first plate 202 in the testing chamber 201 is adjusted as needed by injecting or pumping out fluid from the first accumulator chamber 211 and second accumulator chamber 212.

Although the above describes the mechanisms of the first accumulator 205, first floating piston 209, first accumulator chamber 211, second accumulator chamber 212, first accumulator pump 222, second accumulator pump 223, first plate 202, and first linking rod 206, and the respective connections, it is understood by one of ordinary skill in the art that the second accumulator 207, second floating piston 210, third accumulator chamber 225, fourth accumulator chamber 226, third accumulator pump 224, fourth accumulator pump 227, second plate 203, and second linking rod 208, and the respective connections, as shown in FIG. 2, will possess similar mechanisms as the first accumulator 205.

In particular embodiments, the accumulator has a cylindrical shape. Within the accumulator is a floating piston that can slide in either direction by the differential pressure applied on both sides of the piston. The differential pressure is induced by injecting liquid into one side of the piston while retrieving liquid from the other side.

Figure 4:
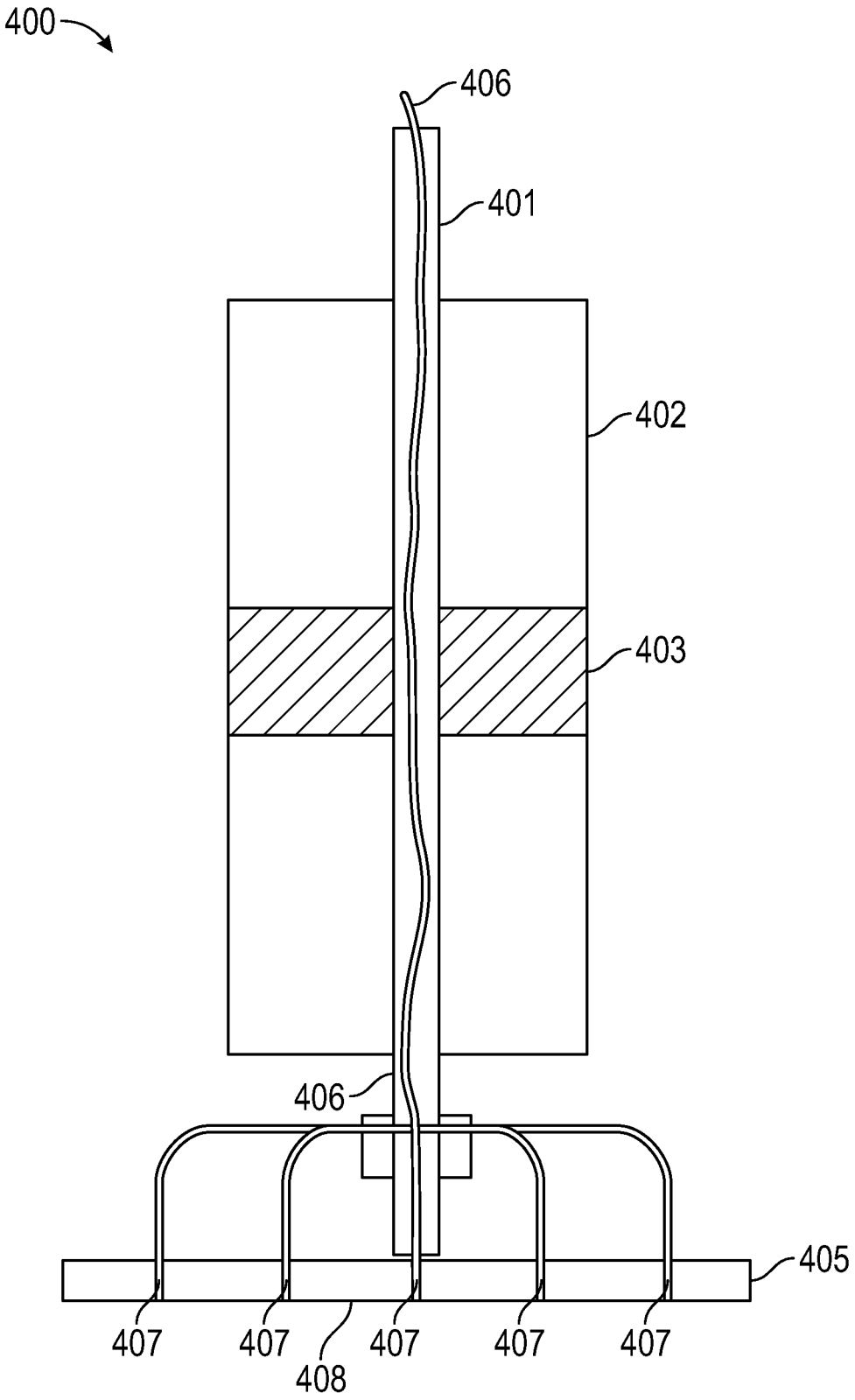
FIG. 4 is a schematic of an accumulator system used in embodiments of the present disclosure.

As shown in FIG. 2, the first linking rod 206 and second linking rod 208 may be hollow tubes to allow cables, such as electric wires, to pass through the linking rod. In some embodiments, the electric wires may be thermocouples. FIG. 4 depicts a cross-section of an accumulator system 400. The hollow linking rod 401 runs through the accumulator 402, attaches to the floating piston 403, and through to attach at the plate 405. The hollow linking rod 401 may be attached to the floating piston by welding or a threaded connection, for example. A thermocouple 406 runs through the hollow length of the linking rod 401 and attaches to at least one connection point 407 on the plate 405. The thermocouple 406 may be embedded at the connection point 407 through the width of the plate 405 with the sensor thermocouple tip at the connection point 407 flush with the plate face 408 that is exposed to the simulated fracture area of the chamber (not shown). The thermocouple 406 may be connected to a recording instrument (not shown) that records the temperature measurements captured by each sensor thermocouple tip at connection points 407.

In some embodiments, the testing chamber may include an inlet opening and an outlet opening to allow for the injection and flow of fluid through the testing chamber. Fluid may be understood to mean any liquid that may be used to test the diverting agent, including the diverting agent, fracturing fluid, and pad fluid.

In the embodiment shown in FIG. 2, the inlet opening 213 and outlet opening 214 are shown on the opposite sides of parallel walls in the testing chamber 201. The shape of the inlet opening 213 and outlet opening 214 can be, but is not limited to, rectangular (as shown in FIG. 2), square, elliptical, or circular. End plates, such as the inlet endplate 215 and outlet endplate 216, may be used to connect with tubing 217, that may be fluidly connected to diverting fluid injection pump (not shown) or a fluid circuit system (not shown).

Figure 5:
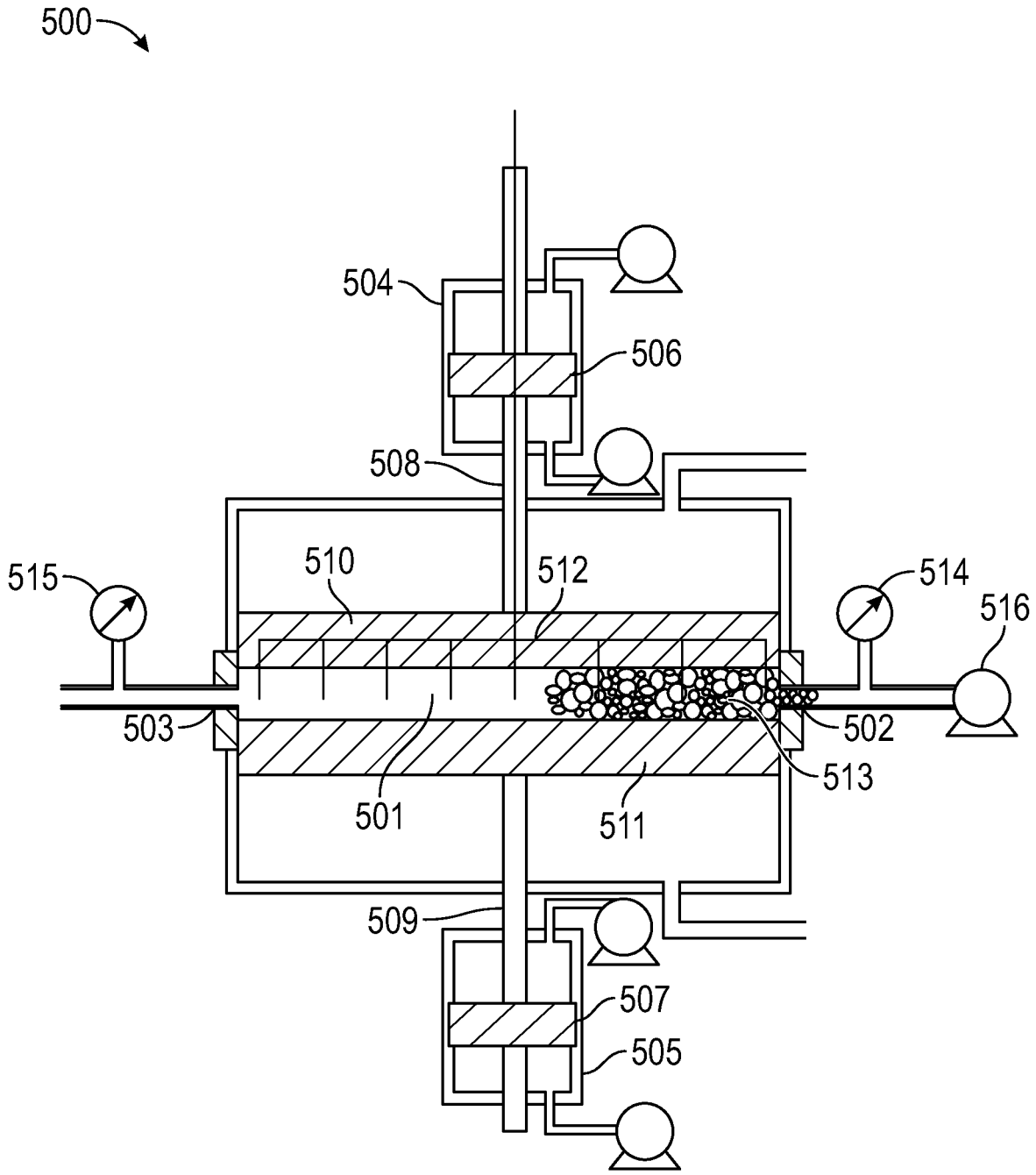
FIG. 5-6 are schematics of a dynamic testing apparatus used in embodiments of the present disclosure.
Figure 6:
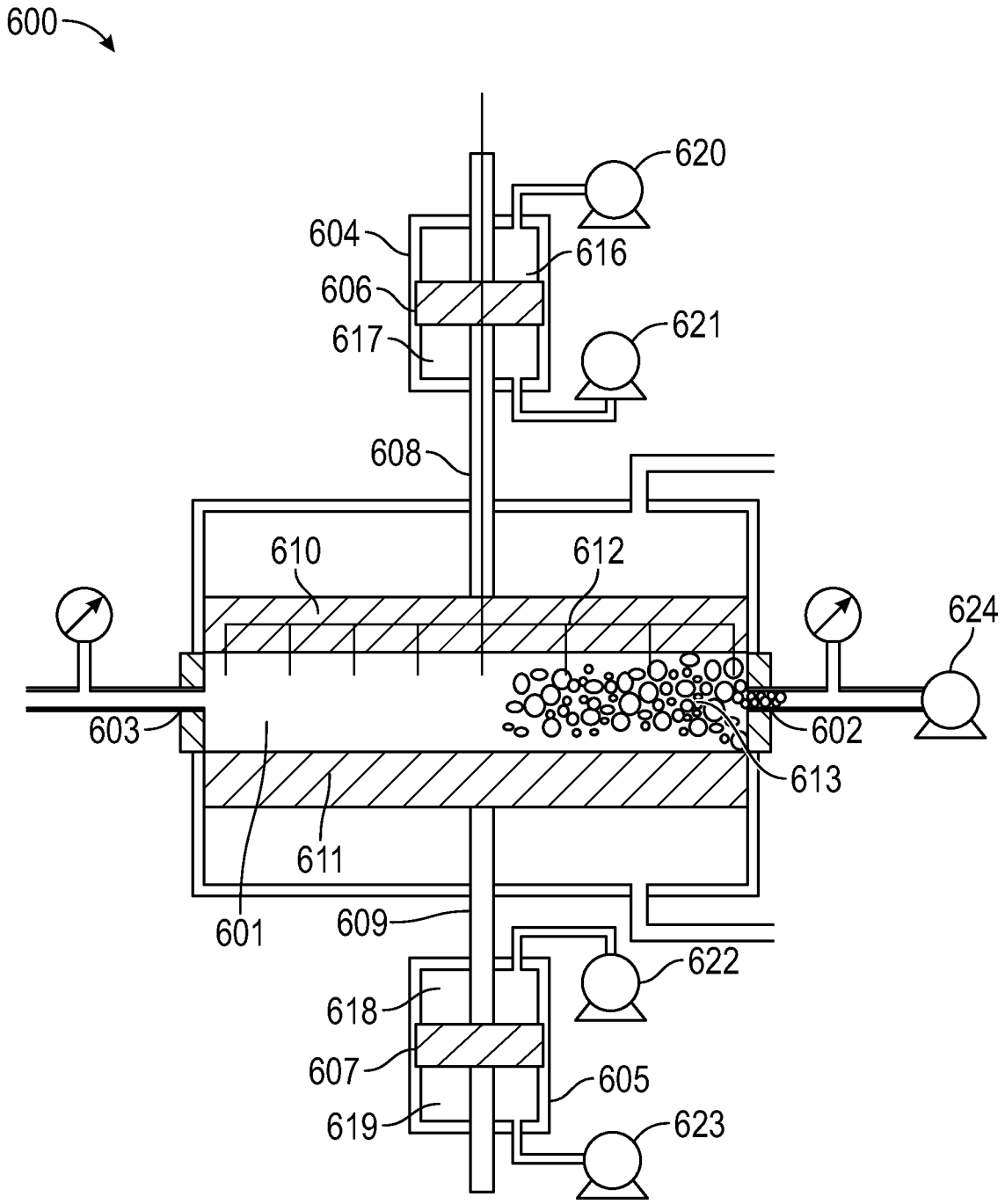

FIG. 2, FIG. 5 and FIG. 6 depict an embodiment of the present disclosure with two moving plates that create the simulated fracture with the testing chamber. While the shape and material of chamber is not limited, the simulated fracture has at least two surfaces: a testing chamber surface and at least one surface capable of movement. While FIG. 2, FIG. 5, and FIG. 6 show simulated fractures with a testing chamber and two plates capable of movement, one of those plates may be fixed while maintaining the advantages of the testing device. For example, when one moving plate is used, such as the first plate 202 as shown in FIG. 2, the other plates remain in a fixed position, including the second plate 203.

FIG. 5 and FIG. 6 depict cross sections of certain embodiments of the present disclosure. Dynamic testing apparatus 500 and dynamic testing apparatus 600 have several aspects that are similar to and appreciated in the dynamic testing apparatus 200, as previously described.

As seen in FIG. 5 and FIG. 6, in certain embodiments the testing apparatus may include a testing chamber (testing chamber 501 and testing chamber 601) that simulates the dynamic conditions inside a formation fracture. In some embodiments of the present disclosure, the testing chamber may be fluidly connected to a fluid circuit system (not shown). The circuit serves to supply fluid, (which may be the diverting agent or a slurry containing the diverting agent, for example), to the chamber through a fluid inlet (fluid inlet 502 and fluid inlet 602), as well as discharge the fluid from the chamber via a fluid outlet (fluid outlet 503 and fluid outlet 603). Upstream of fluid inlet 502 and fluid inlet 602 may be at least two sources of fluid: a diverting agent reservoir and a fluid feed. The diverting agent reservoir may store, mix, and deliver diverting agent fluid or fluid with diverting agent, via diverting agent fluid pump 516 and diverting agent fluid pump 624. Additionally, fluid may come from an outside source, like a hose, through fluid feed. Routing of at least one of these two fluids into the testing chamber 501 and testing chamber 601 may occur via a flow direction valve. Also, a flow control valve to control the flow of fluids into testing chamber 501 and testing chamber 601 may be positioned between the flow direction valve and fluid inlet 502 and fluid inlet 602. These two fluids may be supplied in any combination, including simultaneously or separately.

FIG. 5 depicts the dynamic testing apparatus 500 prior to a change in simulated fracture width. FIG. 5 depict several of the same parts as described above, including a first accumulator 504, a second accumulator 505, a first floating piston 506, a second floating piston 507, the first linking rod 508 and second linking rod 509, a first plate 510 and a second plate 511, as well as thermocouples 512. It will be understood by those skilled in the art that thermocouples 512 may also be present in a second plate 511 in certain embodiments.

As a diverting agent fluid with particulate diverting agent 513 is injected into the testing chamber 501 via the fluid inlet 502, the pressure is measured at the fluid inlet 502 ("upstream") by the inlet pressure gauge 514 and fluid outlet 503 ("downstream") by the outlet pressure gauge 515. The fluid inlet 502 to the simulated fracture is plugged, or blocked, by the injected particulate diverting agent 513. As seen in FIG. 5, the particulate diverting agent 513 is disposed in the testing chamber 501 close to the fluid inlet 502 to restrict fluid flow through the simulated fracture. When the diverting agent 513 forms a plug, the carrier fluid may leak through the packed solid bed built up by the accumulation of the diverting solid. The pressure will increase and eventually the solid bed will be very low in permeability so even the filtrate cannot pass through. Further, while the present embodiments have described a solid diverting agent carried in a fluid (i.e., as a slurry), it is also envisioned that the diverting agent itself is a fluid.

FIG. 6 depicts the dynamic mechanics of the embodiments of the present disclosure. Once the particulate diverting agent 613 prevents further flow into the simulated fracture via the fluid inlet 602, hydraulic fluid exits from the first accumulator chamber 616 via first accumulator pump 620 and hydraulic fluid enters the second accumulator chamber 617 via second accumulator pump 621. A similar action occurs in the second accumulator 605 as the first accumulator 604, wherein the hydraulic fluid is pumped out of the fourth accumulator chamber 619 via a fourth accumulator pump 623 and hydraulic fluid is pumped into the third accumulator chamber 618 via third accumulator pump 622. As a result, the first floating piston 606 and the second floating piston 607 move in a direction away from the testing chamber 601 and transverse to the fluid flow through the simulated fracture of the testing chamber 601.

The movement of the first floating piston 606 and second floating piston 607 moves the first plate 610 and second plate 611 via first linking rod 608 and second linking rod 609, respectively. Thus, the movement of the first plate 610 and second plate 611 changes (increases) the width of the testing chamber 601 simulated fracture, thereby changing the flow channel in the simulated fracture in a transverse direction relative to the fluid flow. The change in simulated fracture width impacts the integrity of the particulate diverting agent 613 in the simulated fracture wherein the particulate diverting agent 613 loosens and moves through the simulated fracture. The particulate diverting agent 613 no longer restricts movement of the fluid through the simulated fracture of the testing chamber 601 and fluid flow resumes through the simulated fracture.

In one or more embodiments, the effectiveness of diverting agents may be measured and evaluated in a testing environment that simulates the dynamic geometry of a real world fracturing operation, and in particular, a real downhole fracture diversion operation. As describe above and seen in at least FIG. 6, the width of the simulated fracture may be changed much like a real world fracture may change (whether along length or due to changes in downhole conditions). Thus, the effectiveness of the diverting agent may be measured, particularly how the sealing ability is affected by a change in fracture width.

It is understood by those skilled in the art that one or more embodiments of the present disclosure may increase and decrease the width of the simulated fracture. It is also understood by those skilled in the art that the control mechanisms for controlling the geometry of the simulated fracture may be a wide variety of known mechanisms, such as manually controls and programmed computer controls.

Figure 7:
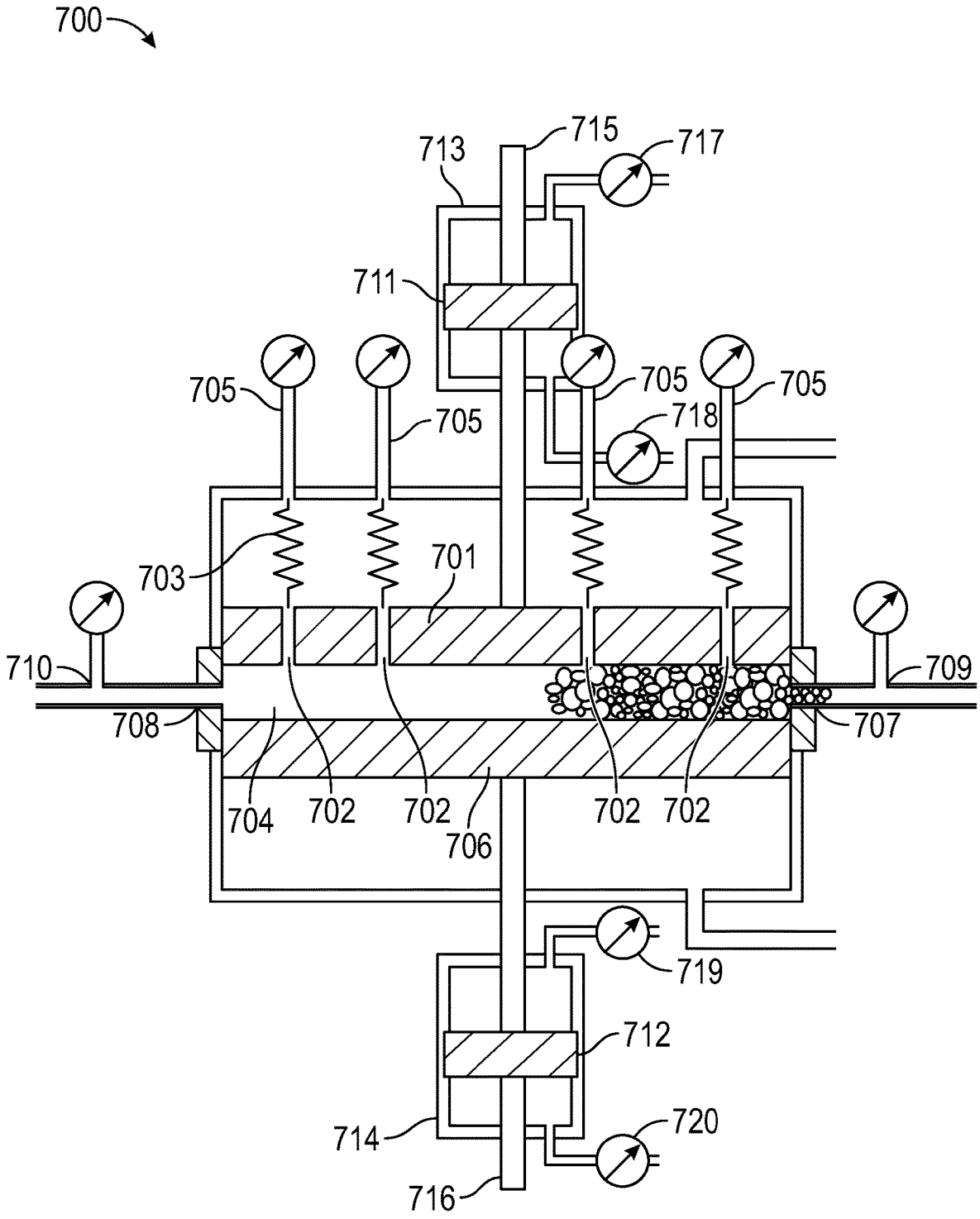
FIG. 7 is a schematic of a dynamic testing apparatus with pressure taps used in embodiments of the present disclosure.

FIG. 7 depicts a similar embodiment as FIG. 5 with the addition of pressure taps. Pressure measurement mechanisms, such as pressure taps, may be incorporated in one or more embodiments. As seen in the dynamic testing apparatus 700 in FIG. 7, a series of pressure taps 702 are fitted in the first plate 701. Pressure taps are holes drilled through plates, here first plate 701. The holes are connected by a coiled tubing 703 inside the testing chamber 704 to the tubing 705 outside the chamber. The tubing 705 may be filled with a fluid to ensure pressure measurement transmission. The coiled tubing 703 inside the chamber provides spring-like action to absorb the movement of the respective first plate 701 and second plate 706 and ensure the tubing 705 connection outside the testing chamber 704 remains intact. The pressure taps 702 measure the pressure profile in the simulated fracture though the length of the first plate 701 and second plate 706. It is understood by those skilled in the art that pressure taps may also be inserted into other surfaces that run along the simulated fracture, such as second plate 706. As seen in FIG. 2, the pressure profile measurement may also be achieved by pressure taps 218 through the sides of the chamber sides 219.

In embodiments of the present disclosure, the pressure profile may be used to characterize the plug formed by the diverting agent. For example, the pressure profile helps determine the length of the plug within the testing chamber. Determining the length of the plug within the testing chamber may be advantageous because this information provides a way of evaluating the effectiveness of the diverting agent's bridging ability. This information may help design the volume of material to be injected when scaled to a real world application. For example, a thin plug (i.e., a plug is formed in a small fraction of the overall testing chamber volume) may indicate that the material is more effective by rapidly bridging the fracture width such that less diverting material is needed to form a plug. Moreover, when flow reverses during back production, the cleanup of such thin diverting agent plug may be easier as there is less material to collect.

In one or more embodiments, pressure measurements may also occur at fluid inlet 707 at inlet pressure sensor 709 and fluid outlet 708 at outlet pressure sensor 710.

In one or more embodiments, pressure measurements may also occur at either side of the floating pistons in the accumulators (see first floating piston pressure gauge 717, second floating piston pressure gauge 718, third floating piston pressure gauge 719 and fourth floating piston pressure gauge 720). These pressure measurements capture the pressure of the hydraulic fluid inside the respective accumulator chambers.

In one or more embodiments, the changing of the flow channel, as defined by the testing chamber 704 in FIG. 7, in a transverse direction may be controlled by the changing pressure in the testing chamber 704. In some embodiments of the present disclosure, the changing of the flow channel may be an automated process. A control system (not shown) may be configured to receive input from pressure sensing mechanisms, such as the pressure taps 702, the inlet pressure sensor 709, and outlet pressure sensor 710. The pressure sensors may be standard electronic pressure transducers. In the automated process, the control system may comprise software to control the movement of the floating piston (first floating piston 711 and second floating piston 712) inside the accumulator (first accumulator 713 and second accumulator 714). The movement of the floating pistons, in turn, moves the plates (first plate 701 and second plate 706, respectively) via mechanisms described above.

In some embodiments of the present disclosure, a predetermined inlet pressure may be programmed in the software. As the diverting agent testing process is initiated, pressure measurements are collected at pressure sensors, such as inlet pressure sensor 709. The pressure measurements may be collected by a standard electronic data acquisition system in communication with the software. Once the predetermined pressure is reached, the control system software may issue a command to induce movement of first plate 701 and/or second plate 706 using the mechanisms described above to change the width of the flow channel (as a simulated fracture) in the transverse direction. The software in the control system may trigger first accumulator pump 620 and second accumulator pump 621 to start pumping or draining hydraulic fluid until a predetermined pressure inside testing chamber 601 is reached. The pumping and draining of hydraulic fluid in the accumulator moves the floating piston, which in turn moves the plate and therefore changes the flow channel (or fracture) width.

In some embodiments of the disclosure, an autonomous feedback operation may control the changing of the flow channel. For example, in one or more embodiments, the diverting agent may plug, or block flow deep within the testing chamber, such as testing chamber 704. With the blockage in a place wherein the fluid flow may continue to exert inlet pressure but does not flow through the entire length of the testing chamber, the inlet pressure becomes a force exerted on the plate. As described above, the plate, such as first plate 701 and/or second plate 706, is linked to the respective floating piston by the respective linking rod. If the force induced by the inlet pressure as a result of the fluid flow exceeds the resistant force exerted by the accumulator pressure on the piston, the plate will move up and push the floating piston up as well. The accumulator will drain hydraulic fluid to maintain a pre-set accumulator pressure.

The pressure differential between the inlet pressure at inlet pressure sensor 709 and the pressure at any point in the testing chamber 704 may also be used as a triggering mechanism to change the flow channel.

It is also envisioned in some embodiments of the present disclosure that the changing of the flow channel may be a manual process, wherein a human interface ("operator") controls the accumulator by manually moving at least one of the linking rods (first linking rod 715 and linking rod 716, as shown in FIG. 7). In a manual process, the operator may determine an inlet pressure wherein the floating piston (first floating piston 711 and second floating piston 712) may be moved and also determine the amount of movement.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A method of testing diverting agents, comprising:

injecting a diverting agent into a testing device configured to receive a fluid through a flow channel; and changing the flow channel in a transverse direction relative to the direction of the fluid flow, wherein the changing the flow channel is accomplished by at least one accumulator, wherein the accumulator comprises an internal floating piston and a rod, the rod connected to the internal floating piston and the at least one plate configured to move transverse to the fluid flow.

2. The method of claim 1, further comprising measuring a pressure profile across the flow channel.

3. The method of claim 2, further comprising measuring the pressure profile before and after changing the flow channel.

4. The method of claim 1, wherein the changing of the flow channel in a transverse direction is controlled by changing pressure in the flow channel.

5. The method of claim 1, wherein the changing of the flow channel in a transverse direction is controlled by a control system.

6. The method of claim 1, wherein as fluid flows through the flow channel, the diverting agent forms a plug in the flow channel.

7. A method of testing diverting agents, comprising:

injecting a diverting agent into a first opening of a chamber, the chamber comprising a at least one plate defining a width of a flow channel, changing the position of the at least one plate, thereby changing the flow channel in a transverse direction relative to fluid flow therein, wherein the changing the position of the at least one plate is accomplished by at least one accumulator, wherein the accumulator comprises an internal floating piston and a rod, the rod connected to the internal floating piston and the at least one plate configured to move transverse to the fluid flow; and measuring the pressure profile of the diverting agent along the at least one plate.

8. The method of claim 7, further comprising stopping fluid flow through the chamber at the first opening with the diverting agent.

9. The method of claim 7, wherein the changing of the flow channel in a transverse direction is controlled by changing pressure in the flow channel.

10. The method of claim 7, wherein the changing of the flow channel in a transverse direction is controlled by a control system.

11. The method of claim 7, further comprising measuring the movement of the floating piston with the rod.

12. The method of claim 7, wherein the chamber comprises at least one fixed plate.

13. The method of claim 7, wherein the chamber comprises at least one plate capable of dynamic movement.

14. The method of claim 7, further comprising measuring the temperature of the diverting agent in the chamber.

15. The method of claim 7, wherein the at least one plate comprises at least one hole configured to measure a pressure in the chamber.

16. A system to test diverting agents, comprising:

a chamber configured for a fluid flow comprising at least one plate extending therethrough from a first opening to a second opening, thereby defining a length of a fluid channel, the at least one plate fitted within the chamber and configured to move transverse to the fluid flow, thereby changing a width of the fluid channel; and at least one accumulator, wherein the accumulator comprises an internal floating piston and a rod, the rod connected to the internal floating piston and the at least one plate configured to move transverse to the fluid flow.

17. The system of claim 16, wherein at least one pump is connected to the at least one accumulator.

18. The system of claim 16, wherein the accumulator is a hydraulic accumulator.

19. The system of claim 16, further comprising a temperature sensor connected to the chamber.

20. The system of claim 16, further comprising a pressure sensor.

21. The system of claim 20 wherein the pressure sensor is a pressure tap comprising at least one hole in the at least one plate, wherein a coiled tubing extends from inside the chamber to outside the chamber through the hole.

* * * * *